US007143697B2

(12) United States Patent
Mace et al.

(10) Patent No.: US 7,143,697 B2
(45) Date of Patent: Dec. 5, 2006

(54) APPARATUS AND METHOD FOR IDENTIFYING AMMUNITION

(75) Inventors: Steve Mace, Seattle, WA (US); Russell H. Ford, Seattle, WA (US)

(73) Assignee: Ravensforge LLC, Seattle, WA (US)

( * ) Notice: Subject to any disclaimer, the term of this patent is extended or adjusted under 35 U.S.C. 154(b) by 0 days.

(21) Appl. No.: 10/617,124

(22) Filed: Jul. 9, 2003

(65) Prior Publication Data

US 2005/0005806 A1 Jan. 13, 2005

(51) Int. Cl.
*F42B 5/00* (2006.01)

(52) U.S. Cl. ..... 102/430

(58) Field of Classification Search ..... 102/430, 102/293, 473, 501, 532; 42/1.01
See application file for complete search history.

(56) References Cited

U.S. PATENT DOCUMENTS

| | | | | | |
|---|---|---|---|---|---|
| 1,632,156 | A * | 6/1927 | Wiley | 102/501 |
| 1,650,908 | A * | 11/1927 | Ramsey | 42/106 |
| 1,887,324 | A * | 11/1932 | Pocoroba | 40/629 |
| 2,592,434 | A * | 4/1952 | Krasnow | 102/513 |
| 4,035,942 | A * | 7/1977 | Wiczer | 42/78 |
| 4,150,624 | A * | 4/1979 | Hammond | 102/293 |
| 4,222,330 | A * | 9/1980 | Krystyniak | 102/430 |
| 4,895,076 | A * | 1/1990 | Looger et al. | 102/439 |
| 5,225,628 | A * | 7/1993 | Heiny | 102/438 |
| 5,400,716 | A | 3/1995 | Mayer | |
| 5,485,789 | A | 1/1996 | Collier | |
| 5,511,483 | A | 4/1996 | Griffin, Jr. | |
| 5,646,365 | A | 7/1997 | Collier | |
| 5,698,816 | A | 12/1997 | Roxby | |
| 5,834,660 | A * | 11/1998 | Whalen et al. | 73/864.34 |
| 6,209,459 | B1 * | 4/2001 | Kaufman et al. | 102/439 |
| 6,293,204 | B1 * | 9/2001 | Regen | 102/430 |
| 6,810,816 | B1 | 11/2004 | Rennard | 102/430 |
| 6,886,284 | B1 * | 5/2005 | Lizotte | 42/1.01 |
| 2003/0217665 | A1 * | 11/2003 | Rennard | 102/430 |

* cited by examiner

*Primary Examiner*—T. Nguyen
(74) *Attorney, Agent, or Firm*—Dorsey & Whitney, LLP

(57) ABSTRACT

The present invention is directed to identifying ammunition. In one embodiment, an identifiable ammunition cartridge includes a bullet having a first identification surface, a casing having a second identification surface, and an identifying code positioned on at least one of the first and the second identification surfaces. In another embodiment, a method for identifying ammunition includes selecting a first code portion and a second code portion, and combining the first code portion with the second code portion to form an identifier that may be applied to the ammunition. In still another embodiment, a method for tracking ammunition having an identifier includes storing the identifier and a corresponding identity of a first custodian in a data storage system, transferring the ammunition to a second custodian, associating the ammunition identifier with an identity of the second custodian, and storing the identity corresponding to the second custodian in the data storage system.

18 Claims, 3 Drawing Sheets

| $n$ | NO. PERMUTATIONS | NO. CARTRIDGES THAT MAY BE MARKED | 50 / BOX |
|---|---|---|---|
| 4 | $6.1 \times 10^{7}$ | $1.8 \times 10^{8}$ | $9 \times 10^{9}$ |
| 5 | $5.3 \times 10^{9}$ | $1.6 \times 10^{10}$ | $8 \times 10^{11}$ |
| 6 | $4.5 \times 10^{11}$ | $1.4 \times 10^{12}$ | $7 \times 10^{13}$ |

$(P=N!/(N-n)!)$

APPARATUS AND METHOD FOR IDENTIFYING AMMUNITION

TECHNICAL FIELD

The present invention relates generally to the identification of ammunition, and more specifically, to the application of an identifying mark to ammunition.

BACKGROUND OF THE INVENTION

It has long been recognized that firearms form an identifiable series of marks, or striations on a projectile as it is discharged from the firearm. Since the striations generally result from minor differences that ordinarily arise during the manufacture of the firearm, the striations are generally unique, so that detectable differences exist even for firearms contemporaneously produced by the same manufacturer. As a result, forensic ballistic investigations often use these unique striation patterns to establish an association between a recovered projectile, such as a bullet, and a firearm.

Various methods have been proposed that employ the striations formed on the projectile as the basis for an identification system for firearms. In one method, generally referred to as "ballistic fingerprinting", a test cartridge is discharged from a firearm prior to the sale of the firearm. The components of the test cartridge are recovered and retained in a repository so that they may be accessed at some future time when ownership of the firearm must be established. Identifiable characteristics associated with the test cartridge components may include striation marks on a bullet, a firing pin mark on a cartridge casing, extractor marks on a rim of the casing, or other readily identifiable marks. Alternatively, the components of the test cartridge may be photographed or scanned to form an image record of the recovered components so that the image record may be stored in a data base. In either case, when the firearm is sold, the identity of the purchaser is associated with the information obtained from the test cartridge. When it becomes necessary to determine ownership of the firearm, for example, following the commission of a crime using the firearm, the recovery of the components of a cartridge discharged at the crime scene will permit the owner of the firearm to be identified by comparing the recovered components to the components retained in the repository, or alternatively, by comparing the recovered components to imagery stored in the data base.

Despite the obvious advantages afforded by ballistic fingerprinting methods, drawbacks nevertheless exist. For example, firearms manufactured and sold before the implementation of a ballistic fingerprinting program would not be identifiable through the program, since no test cartridge information would be present in a repository or a data base for these firearms. Accordingly, most of the firearms now in existence would remain non-traceable despite the implementation of the ballistic fingerprinting program. Further, even if test cartridge information exists for a firearm, certain methods used to manufacture components of the firearm may present difficulties when attempting to identify a firearm by ballistic fingerprinting. For example, in one present method, the barrel and receiver portion of the firearm is formed by shaping the barrel and receiver on a mandrel. The mandrel generally includes distinctive machining marks that are subsequently transferred to the barrel and receiver as they are formed. Accordingly, a large number of barrel and receiver portions formed on a common mandrel will generally include similar marks or striations that correspond to the marks present on the mandrel, thus reducing the presence of unique and readily identifiable patterns on the test cartridge. Additionally, components of the firearm may be selectively altered by reconfiguring the barrel and/or the receiver portion of the firearm so that it produces striations that differ significantly from the striation pattern that was obtained when the test cartridge was fired. Consequently, traceability of the firearm with reference to the test cartridge information could be easily defeated. Still further, the barrel and/or receiver portions of the firearm undergo various changes during normal use that may significantly affect the striations in the barrel, so that the fingerprint information associated with the firearm gradually changes over time.

Still other problems present exist with present ballistic fingerprinting methods. For example, components from different firearms may be exchanged, or may simply be replaced at some time during the life of the firearm as a part of a repair operation. In such cases, traceability is also lost since there is generally no requirement to document these operations in a ballistic fingerprinting program. Finally, the traceability of a firearm may also be lost by transferring ownership of the firearm to others through a series of undocumented personal transactions, so that the chain of ownership is lost.

An alternative approach is to position an identifying mark on a cartridge before the cartridge is sold, and to associate an identity corresponding to a purchaser with the identifying mark on a portion of a cartridge. Several significant advantages are evident in this approach. In general, no governmental agency would be required to supervise the test cartridge firing, and to retain the information in a central repository, or data base. Instead, ammunition having an identifying mark could be conveniently tracked through a chain of supply in a manner similar to ordinary inventory tracking, so that the costs associated with tracking the ownership of the marked ammunition are widely distributed. Furthermore, since the burden associated with identification of the firearm is effectively shifted from the firearm to the ammunition, the identity of a firearm owner or user may be determined without regard to the age of the firearm, so that all firearms currently in existence could be traced. Moreover, modification of the firearm by altering selected portions of the firearm would be ineffective in defeating an ammunition marking system. Still further, ammunition marking could not, in general, be defeated by undocumented firearms sales, since the documentation is associated with the ammunition rather than the firearm.

Various methods are present in the prior art for placing an identifying mark on ammunition. For example, U.S. Pat. No. 1,650,908 to Ramsey discloses an ammunition marking system that includes forming a single identifier on a rear face of a bullet. The single identifier, however, may be rendered unreadable by deformation of the bullet, thus defeating subsequent attempts to identify the bullet. Moreover, the single identifier is limited to the expression of relatively few numbers. Ramsey further discloses forming a single identifier on a rear surface of a cartridge by transferring an identifier present on a surface of a hammer of the firearm on to a rear surface of the cartridge. One particular shortcoming present in this approach is that it requires a suitably configured firearm.

Another prior art approach is described in U.S. Pat. No. 6,293,204 B1 to Regen, which discloses marking ammunition components with a binary code array. The array is a compact method for forming a binary number, so that many distinct numbers may be expressed. Although the binary arrays disclosed by Regen allow the formation of more distinct numbers than permitted by Ramsey, the method still relies on the formation of a single number on the ammunition component. Consequently, if various bits within the binary array are rendered unreadable by deformation of the bullet, or by other means, subsequent identification of the ammunition component may not be possible. In addition, the binary array may not be deciphered by persons not having specialized training directed to reading the contents of the binary array. Accordingly, the ability of law enforcement agencies to read the contents of the array and to readily identify the ammunition component is impeded.

What is required in the art is a marking method that allows an identifying mark to be repetitively formed on an article of ammunition so that at least one of the marks remains identifiable despite the deformation or even partial destruction of the ammunition components.

SUMMARY OF THE INVENTION

The present invention is generally directed to an apparatus and methods for the identification of ammunition, and more specifically, to the application of an identifier to ammunition. In a first aspect, the invention includes an identifiable ammunition cartridge for a firearm having a bullet having a first identification surface, a casing that retains the bullet, the casing having a second identification surface, and an identifying code positioned on at least one of the first and the second identification surfaces. In another aspect of the invention, a method for identifying an ammunition article having at least one component includes selecting a first code portion and a second code portion, and combining the first code portion with the second code portion to form an identifier, and forming the identifier on the at least one component of the ammunition article. In still another aspect, a method for tracking ammunition having a pre-selected identifier includes storing the identifier and a corresponding identity of a first custodian of the ammunition in a data storage system, transferring the ammunition to a second custodian and associating the ammunition identifier with an identity corresponding to the second custodian, and storing the identity corresponding to the second custodian in the data storage system.

DETAILED DESCRIPTION OF THE INVENTION

The present invention is generally directed to the identification of ammunition, and more specifically, to the application of an identifier to ammunition. Many of the specific details of certain embodiments of the invention are set forth in the following description and in FIGS. 1 to 4 to provide a thorough understanding of such embodiments. One skilled in the art will understand, however, that the present invention may be practiced without several of the details described in the following description. Moreover, in the description that follows, it is understood that the figures related to the various embodiments are not to be interpreted as conveying any specific or relative physical dimension. Instead, it is understood that specific or relative dimensions related to the embodiments, if stated, are not to be considered limiting unless the claims expressly state otherwise.

Figure 1:
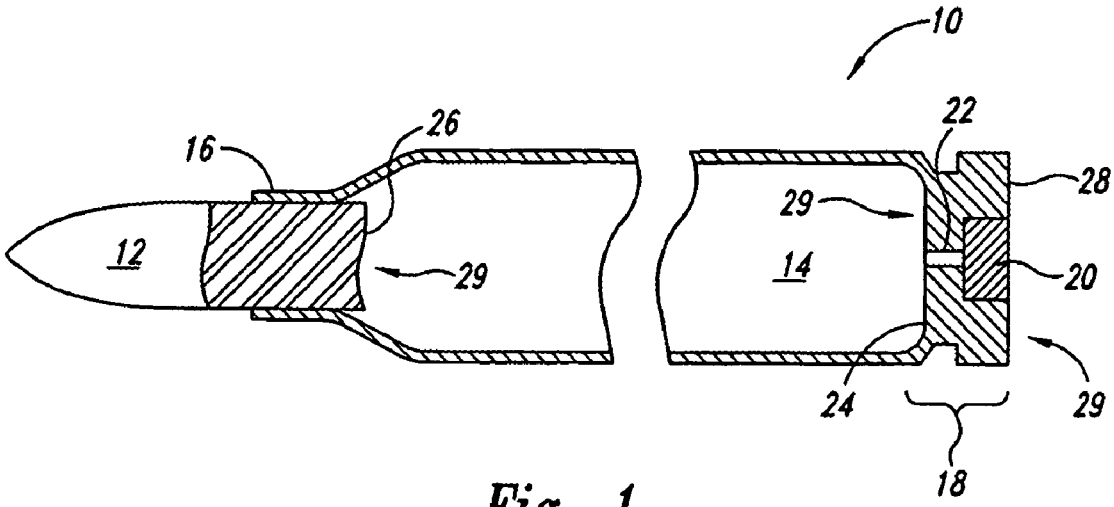
FIG. 1 is a partial cross-sectional view of a marked cartridge according to an embodiment of the invention.

FIG. 1 is a partial cross-sectional view of a marked cartridge 10 according to an embodiment of the invention. The cartridge 10 includes a bullet 12 that is at least partially retained by a casing 14 having a generally hollow interior that contains a propellant (not shown). The casing 14 includes a neck 16 that retains the bullet, usually by an interference fit between the bullet 12 and the neck 16. The casing 14 also includes a head 18 having a primer 20 that is embedded in the head 18 that is exposed to the propellant through a flash hole 22. The casing 14 also includes a generally flat web 24 on an interior portion of the head 18. In one particular embodiment of the present invention, an identifier 29 may be placed on a base 26 of the bullet 12. The identifier 29 may be placed on the bullet 12 by any of a number of well-known methods for marking a metallic object, such as engraving, stamping, molding, photoengraving, photolithography, or other similar methods. The identifier 29 includes sequences of independently recognizable characters that are placed on the bullet 12 in repetitive character groups, as will be described in greater detail below.

Figure 1A:
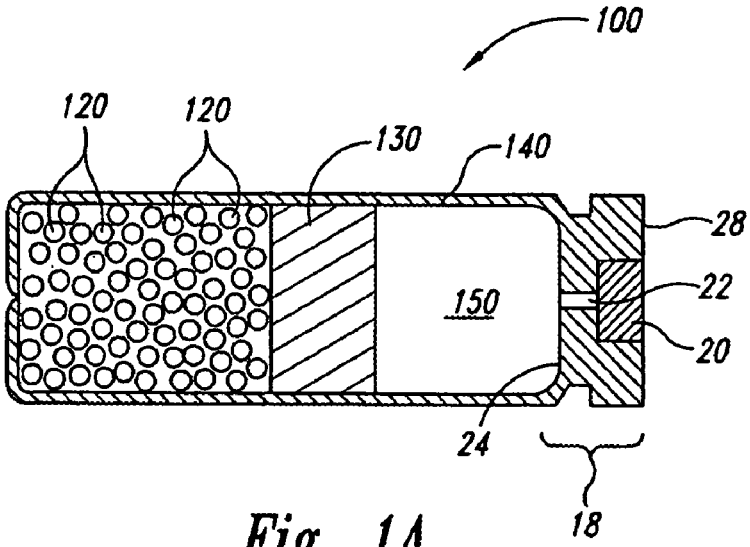
FIG. 1A is a schematic cross-sectional view of a marked shotgun cartridge according to one embodiment of the invention.

In another particular embodiment, the identifier 29 may be placed on an external rim 28 of the head 18, so that the casing 14 may be identified. The casing 14 may be marked by any of the processes suited to marking metallic surfaces, as described above. In still another particular embodiment, the identifier 29 may be placed on the web 24 within the casing 14. Since the identifier 29 is deeply recessed within the casing 14, the identifier 29 is more resistant to tampering or alteration than if placed on the external rim 28 of the casing 14. The identifier 29 may be placed on the web portion 24 by a laser that projects a coherent beam into the casing 14 to form the mark either by discoloring a surface of the case material or by engraving the mark by selectively vaporizing the case material. Although FIG. 1 depicts a marked cartridge 10 that is configured for use in a long rifle or even a handgun, it is understood that the embodiments of the present invention are also applicable to other types of cartridges used in other types of firearms. For example, as shown in FIG. 1A, a cartridge 100 commonly used in shotguns includes an outer generally polymeric casing 140 that includes a propellant 150 located adjacent to a primer 20 positioned in a base end of the cartridge 100, a mass of generally spherically-shaped pellets 120 positioned at an opposing end of the cartridge 100, and a wad material 130 that is positioned between the shot 120 and the propellant 150 to moderate the effect of the acceleration forces on the pellets 120 when the propellant 150 is detonated. When the cartridge is discharged, the wad 130 and the shot 120 are ejected from the cartridge 100. Accordingly, therefore, and in another particular embodiment, the wad may be marked with the identifier 29 so that the recovered wad may be identified.

The foregoing embodiments advantageously provide a cartridge that may be readily identified by inspecting the identifier 29 placed on various components of the cartridge. Since the identifier 29 may be positioned on interior portions of the cartridge, such as on the base 26 of the bullet 12, or upon the web 24 of the casing 14, they are less subject to alteration or eradication by various means, since they cannot be altered unless the cartridge is disassembled to gain access to the identifier 29. In particular, if the identifier 29 is placed on the web 24, the identifier 29 is particularly resistant to alteration or eradication since they are deeply recessed within the case 14.

Figure 2:
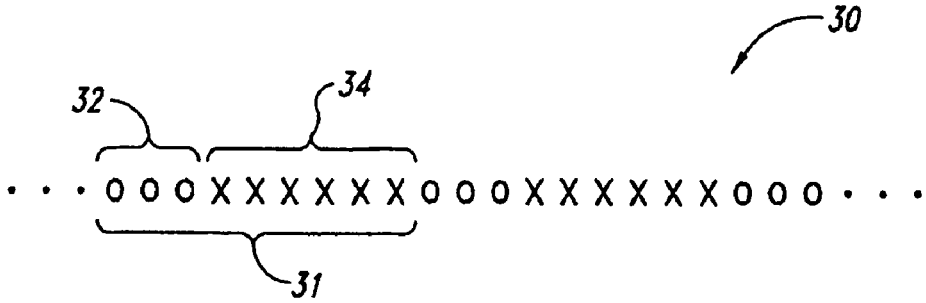
FIG. 2 is a diagrammatic view of a coding method for marking ammunition according to another embodiment of the invention.

FIG. 2 is a diagrammatic view of a coding method 30 for forming the identifier 29 of FIG. 1, according to another embodiment of the invention. The coding method 30 includes a code prefix 32 that is generally formed of similar characters, such as dots, dimples, or other similarly recognizable figures that may be conveniently formed on one or more components of a cartridge 10, as shown in FIG. 1. Although the code prefix 32 may have any number of characters, in a particular embodiment, the number of characters in the code prefix 32 ranges from one to three. The code prefix 32 is followed by a code body 34 that includes a plurality of readily recognizable and distinct characters, herein denoted generally by "X" for purposes of illustration. The code body 34 may similarly include any number of characters, and in another particular embodiment, the number of characters ranges from four to six. The code body 34 may be comprised of an arrangement of characters that are either serially selected, or randomly selected. The combination of the code prefix 32 and the code body 34 comprise a code 31 that is repetitively applied to any of the portions of the cartridge 10 as shown in FIG. 1, so that at least one contiguous combination of the code prefix 32 and the code body 34 may be identified after the cartridge is fired. This aspect is particularly important since the bullet 12 as shown in FIG. 1 may undergo significant deformation after impacting a target.

Figures 2A, 3:
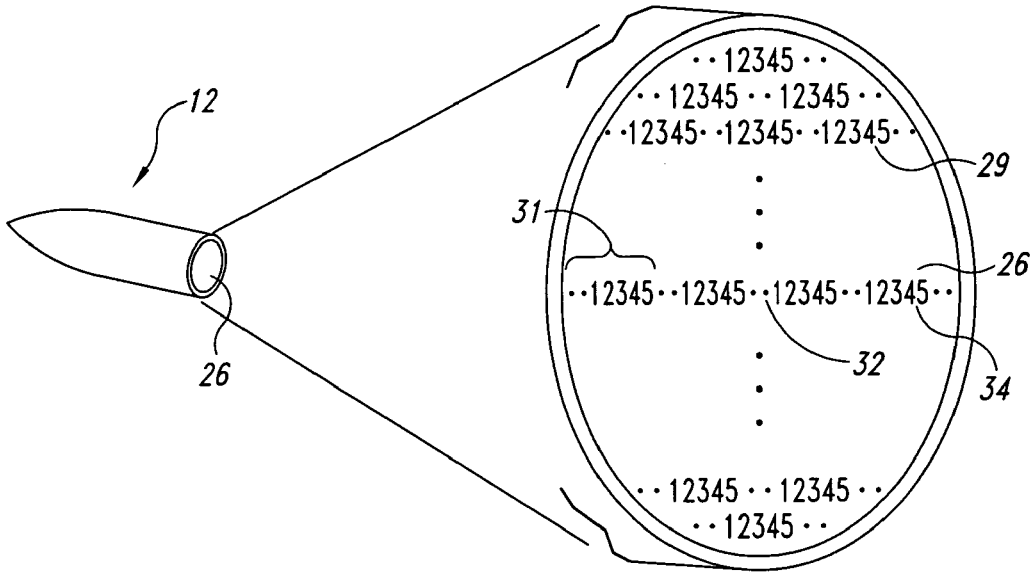
FIG. 2*a* is an isometric view of a bullet that includes an identifier according to a particular embodiment of the invention.
FIG. 3 is a table that illustrates relative numbers of cartridges that may be marked using the coding method.

FIG. 2*a* is an isometric view of the bullet 12 of FIG. 1 that includes the identifier 29 of FIG. 2 according to a particular embodiment of the invention. In FIG. 2*a*, the base 26 of the bullet 12 is shown in magnified form to better illustrate the placement of the identifier 29 on the bullet 12. In this particular embodiment, the code body 34 comprises a group of five characters ("12345"), and the code prefix 32 comprises a pair of dots separating the code body 34. As described above, and shown in detail in FIG. 2*a*, the code prefix 32 and the code body 34 are repetitively applied to the base 26 so that at least one code 31 remains identifiable despite deformation and/or fragmentation of the bullet 12. Although the foregoing particular embodiment depicts a code 31 having a code prefix 32 comprised of a pair of dots, and a code body 34 having five characters, it is recognized that the code 31 shown in FIG. 2*a* is for illustrative purposes only, and that other combinations and sequences of characters may be used. Further, although a linear arrangement of the code 31 on the base 26 is shown in FIG. 2*a*, it is understood that the code 31 may be repetitively applied in other arrangements. For example, and still referring to FIG. 2*a*, the codes 31 may be applied to the base 26 of the bullet 21 in a circular arrangement, or in still other arrangements, and may be staggered, or "word-wrapped" so that the identifier 29 avoids the identifiable formation of columns of codes 31 as the codes 31 are applied to the bullet 12 in rows. As a consequence, the likelihood that a code 31 remains intact after deformation and/or fragmentation of the bullet 12 is significantly enhanced.

FIG. 3 is a table that illustrates the number of cartridges that may be marked by the coding method 30 of FIG. 2. In one particular embodiment, 90 characters are available for forming the code body 34, which correspond to the 90 characters that are available on a standard keyboard commonly associated with a computer device as a data input means. If the code body 34 is comprised of four characters, then approximately $6.1\times10^{7}$ permutations of the 90 character set are available. Since the four-character group may have a code prefix 32 that is comprised of between one and three characters, the total number of cartridges that may be marked with a four character random code is approximately about $1.8\times10^{8}$ cartridges.

The number cartridges that may be marked is increased by the method of packaging employed during manufacture. For example, cartridges are typically supplied to an ultimate consumer in boxes of 50 cartridges. If all of the cartridges in a box are assigned the same code 31, that is, all cartridges in a box include the same code prefix 32 and the same code body 34, then a single code 31 may be applied to approximately about $1.8\times10^{8}$ boxes of cartridges, so that a four character code body 34 is sufficient to mark a total of approximately about $9\times10^{9}$ cartridges.

Still referring to FIG. 3, for the code body 34 having five characters each, approximately about $1.6\times10^{10}$ cartridges may be marked, or alternatively, about $1.6\times10^{10}$ boxes may be marked, so that a total of approximately about $8\times10^{11}$ cartridges may be identified when the cartridges are supplied in 50 cartridge boxes. Similarly, for a six character code body 34, approximately about $1.4\times10^{12}$ cartridges may be marked, so that if the cartridges are supplied in 50 cartridge boxes, a total of approximately about $7\times10^{13}$ cartridges may be marked.

It is well known that cartridges are commonly supplied in various calibers so that they may be used in a variety of different firearms, the caliber of the cartridge, or alternately the firearm generally corresponding to a diameter of a bore in the barrel portion of the firearm. As a result, the diameter, or still other identifiable characteristics related to the bullet shape may be employed as an additional identifying characteristic that augments the code 31 shown in FIG. 2. For example, and referring again to FIG. 3, for a code body 34 that includes four characters, a total of about $9\times10^{9}$ cartridges may be marked, if the cartridges are supplied in a 50 cartridge box. If the caliber of the cartridge is employed as an additional identifiable feature of the cartridge, and, assuming that approximately about eight cartridge calibers are widely used, then the four character code body 34 may effectively mark at least about $7.2\times10^{10}$ cartridges when supplied in boxes consisting of 50 cartridges each. Although the foregoing description has referred to the caliber of a bullet used in the cartridge, it is widely recognized that various calibers of bullets are used with casings having a distinctive shape and size. For example, some casings may be shouldered (as shown in FIG. 1), while others have a casing that is generally tubular in shape. Additionally, some casings may include an extractor groove at the base, while others have a raised rim at the base of the casing. Still other casings may include a primer pocket (also as shown in FIG. 1), while other casings may include a primer material positioned within the rim portion of the cartridge (e.g. "rim fire" cartridges). All of these casing configurations may be included as additional identifying characteristics that may be used to generally extend the number of cartridges that may be marked to generally extend the number of cartridges that may be marked. Although the foregoing estimations are based upon the use of a 90 character set commonly found on a standard keyboard, it is understood that other character sets may also be used, and are therefore within the scope of the invention For example, the ANSI character set commonly found on many personal computers includes 256 characters. Accordingly, the number of cartridges that may be marked may greatly exceed the foregoing estimates when a 256 character set is used.

The foregoing embodiment advantageously provides a method for forming an identifier 29 on an ammunition article. In particular, the combination of a code prefix 32 followed by a code body 34 allows a large number of cartridges to be marked, as described in detail above. Since the identifier 29 is repetitively applied to the cartridge component, the probability that at least a single code 31 of the identifier 29 will remain identifiable upon recovery is greatly enhanced. Further, since the marked cartridges constitute a consumable commodity, and the cartridges are expected to be consumed at some estimated rate per year, the identifiers 29 may advantageously be reused on new cartridges after some determinable period of time, since it expected that the old cartridges will have been expended by then. Other characteristics of the cartridge, such as the caliber of the cartridge, or the shape or configuration of the casing may further be combined with the identifier 29 to further augment the number of cartridges that may be marked.

Figure 4:
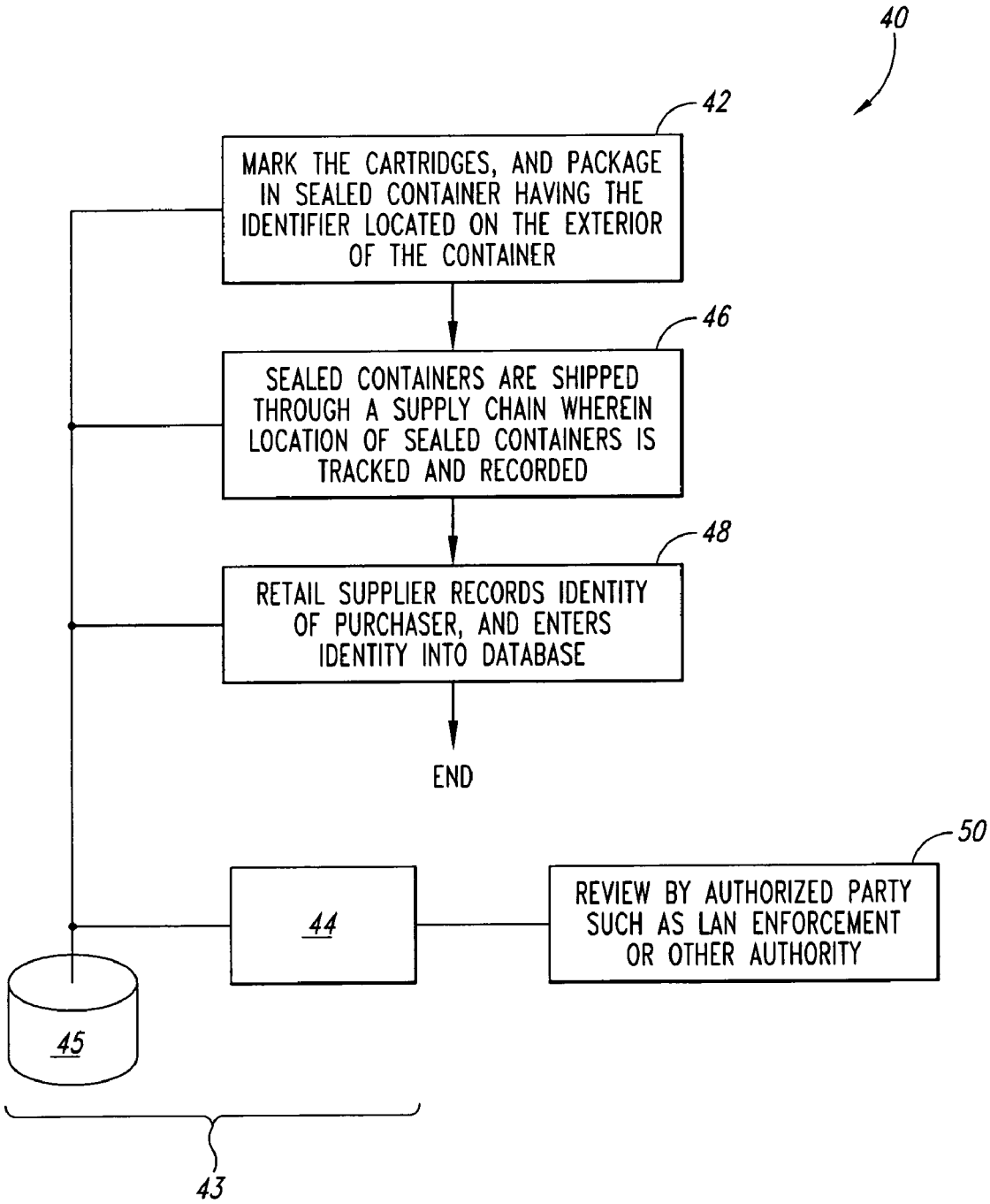
FIG. 4 is a flowchart that illustrates a method for supplying marked ammunition according to still another embodiment of the invention.

FIG. 4 is a flowchart that illustrates a method 40 for supplying marked ammunition, according to still another embodiment of the invention. The method 40 includes the step 42 of marking the cartridges with the identifier 29 of FIG. 1 and packaging the cartridges in sealed containers having an identifying label positioned on an exterior portion of the container. Preferably, the identifying label is one that is tamper proof, so that attempts to change labels on containers, or to alter the label on a container may be readily detected. In a particular embodiment, the identifying information for the cartridges that is comprised of the code 31 of FIG. 2 is further encoded on a bar code label affixed to the container. The identifying information for the cartridge container, together with the manufacturer's identity, may be entered into a data storage system 43 that includes a computer 44 that is coupled to a mass storage device 45. At step 46, the marked cartridges are moved into the supply chain, which typically includes various wholesalers or even retailers. As the marked cartridges are moved through various locations, the location of the sealed containers is recorded by means of the external label, together with the identity of the particular party in the supply chain so that the custody of the sealed containers may be constantly tracked. Accordingly, each time custody of the cartridges changes, as, for example, when a wholesaler transfers ownership to a retailer, an entry is made in the data storage system 43 so that the custody of the marked cartridges is constantly available. At step 48, a retailer sells the marked ammunition to an ultimate consumer. At the point of sale, the retailer records pertinent information regarding the identity of the purchaser, which may include information taken from a vehicle driver's license, or other positive means of identification.

Still referring to FIG. 4, when it is desired to determine the origin of a particular component of an ammunition article that has been recovered, a party authorized to access the data base 43 may determine the location of the ammunition purchase, and may also determine the identity of the purchaser of the ammunition, as shown at step 50. For example, if a bullet, and/or a casing bearing the identifier 29 is recovered by a law enforcement authority at the location of a crime, the identifier 29 may be read, whereupon the data storage system 43 may be accessed to determine the purchaser of the marked ammunition.

The above description of illustrated embodiments of the invention is not intended to be exhaustive or to limit the invention to the precise form disclosed. While specific embodiment of, and examples of, the invention are described in the foregoing for illustrative purposes, various equivalent modifications are possible within the scope of the invention, as those skilled within the relevant art will recognize. Moreover, the various embodiments described above can be combined to provide further embodiments. Accordingly, the invention is not limited by the disclosure, but instead the scope of the invention is to be determined entirely by the following claims.

The invention claimed is:

1. An identifiable ammunition cartridge for a firearm, comprising:

a projectile having a first identification surface;

a casing that is coupled to the projectile that includes a second identification surface; and an identifier positioned on at least one of the first and the second identification surfaces, the identifier further including a code comprised of a plurality of optically identifiable characters, the plurality of optically identifiable characters comprising a combination of alphanumeric characters, the code being identically and repetitively applied to the identification surfaces.

2. The identifiable ammunition cartridge according to claim 1, wherein the first identification surface further comprises a base portion of the projectile.

3. The identifiable ammunition cartridge according to claim 1, wherein the second identification surface further comprises an external rim portion of the casing.

4. The identifiable ammunition cartridge according to claim 1, wherein the second identification surface further comprises a web portion of the casing.

5. The identifiable ammunition cartridge according to claim 1, wherein the code further comprises a code prefix and a code body.

6. The identifiable ammunition cartridge according to claim 5, wherein the code prefix ranges from at least one character to three identical characters, and the code body includes at least four characters.

7. The identifiable ammunition cartridge according to claim 1, wherein the projectile comprises a mass of generally spherically-shaped pellets, further comprising a wad positioned within the casing having a third identification surface, wherein the identifier is positioned on the third identification surface.

8. The identifiable ammunition cartridge according to claim 1, wherein the code is selected from characters available on a standard keyboard.

9. The identifiable ammunition cartridge according to claim 1, wherein the code comprises at least four characters selected from a 256 character set.

10. The identifiable ammunition cartridge according to claim 1, wherein the identifier is formed in identifiable rows and are staggered so that the code does not form identifiable columns.

11. The identifiable ammunition cartridge according to claim 1, wherein the identifier occupies substantially all of the surface area of the identification surface that the identifier is applied to.

12. An identifiable ammunition cartridge for a firearm, comprising:

a projectile comprising a mass of generally spherically-shaped pellets;

a casing that is coupled to the projectile;

a wad positioned within the casing; and an identifier positioned on at least one of the projectile, casing, and wad, the identifier further including a code comprised of a plurality of optically identifiable characters, the code being identically and repetitively applied to the identification surfaces.

13. The identifiable ammunition cartridge according to claim 12, wherein the identifier is positioned on an external rim portion of the casing.

14. The identifiable ammunition cartridge according to claim 12, wherein the code further comprises a code prefix and a code body.

15. The identifiable ammunition cartridge according to claim 12, wherein the code prefix ranges from at least one character to three identical characters, and the code body includes at least four characters.

16. The identifiable ammunition cartridge according to claim 12, wherein the code is selected from characters available on a standard keyboard.

17. The identifiable ammunition cartridge according to claim 12, wherein the code comprises at least four characters selected from a 256 character set.

18. The identifiable ammunition cartridge according to claim 12, wherein the identifier is formed in identifiable rows and are staggered so that the code does not form identifiable columns.

* * * * *